US005685791A

United States Patent [19]

Feeney

[11] Patent Number: 5,685,791

[45] Date of Patent: Nov. 11, 1997

[54] COMPOSITE LACROSSE STICK

[75] Inventor: Brian P. Feeney, Enfield, Conn.

[73] Assignee: Lisco, Inc., Tampa, Fla.

[21] Appl. No.: 580,267

[22] Filed: Dec. 28, 1995

[51] Int. Cl.[6] ..... A63B 59/02

[52] U.S. Cl. ..... 473/513

[58] Field of Search ..... 273/326; 473/513

[56] References Cited

U.S. PATENT DOCUMENTS 3,910,578 10/1975 Brine, Jr. ..... 273/326

4,358,117 11/1982 Deutsch ..... 273/326

4,739,994 4/1988 Lewis, Jr. ..... 273/326

5,067,726 11/1991 Brine, III et al. ..... 273/326

FOREIGN PATENT DOCUMENTS 903285 6/1972 Canada ..... 273/326

*Primary Examiner*—Mark S. Graham

[57] ABSTRACT

A lacrosse stick head comprising a tube with a generally oval-shaped cross section with a length shaped into a closed loop head. The tube is fabricated of elongated fibers in a parallel configuration. The fibers are applied in layers. The fibers being coated in an elastomeric binder material.

1 Claim, 4 Drawing Sheets

COMPOSITE LACROSSE STICK

BACKGROUND OF THE INVENTION

This invention relates to a lacrosse stick and, more particularly, to a lacrosse stick having a head formed from a composite tube shaped into a generally circular configuration with strings therebetween forming a basket, the tube being formed of fibers in a matrix binder material.

DESCRIPTION OF THE PRIOR ART

In lacrosse, players use sticks to catch and toss a ball. The stick is constructed with a frame having a handle portion for being gripped by the player and with a looped head portion with strings forming a basket for catching and tossing the ball and with coupling components between the handle and head for coupling therebetween.

Lacrosse stick frames, including their heads, have been traditionally constructed of a large number of materials. Originally they were constructed of wood. Subsequently, metal and then plastic sticks were utilized to a great extent. More recently, various sporting devices have been constructed of composite materials. Composite materials have become popular since they decrease weight and allow for the tailoring of playing characteristics. Composite devices, however, are expensive, particularly due to more complex fabrication techniques and use of expensive reinforcing filaments such as graphite, glass, aramid, and the like.

By way of example, the prior art discloses in U.S. Pat. No. 4,097,046 to Friant discloses a lacrosse stick head. U.S. Pat. No. 4,270,756 to Ahlenfeld et al. discloses a lacrosse stick head. U.S. Pat. No. 4,358,117 to Deutsch discloses an improved lacrosse head. U.S. Pat. No. 4,657,260 to Brine, Jr. discloses a lacrosse stick head frame. U.S. Pat. No. 4,940,243 to Tucker et al. discloses a lacrosse stick. U.S. Pat. No. 5,007,652 to Tucker et al. discloses a double-wall synthetic lacrosse stick. U.S. Pat. No. 5,035,434 to Taylor et al. discloses a lacrosse stick head. U.S. Pat. No. 5,037,112 to Brine III et al. discloses a lacrosse stick head. U.S. Pat. No. 5,054,790 to Brine III et al. discloses a lacrosse stick head. U.S. Pat. No. 5,067,726 to Brine III et al. discloses a lacrosse stick head. U.S. Pat. No. 5,080,372 to Brine III et al. discloses a lacrosse stick head. U.S. Pat. No. 5,082,290 to Tucker et al. discloses a double-wall synthetic lacrosse stick. U.S. Pat. No. 5,174,580 to Pratt discloses a sport toy for tossing and catching a ball. U.S. Pat. No. 5,269,532 to Tucker et al. discloses a unitary head for a lacrosse stick. U.S. Pat. No. 2,596,894 to Frisch discloses a composite laminated lacrosse stick. U.S. Pat. No. 3,473,806 to Patterson discloses a lacrosse stick fence construction. U.S. Pat. No. 3,507,495 to Tucker discloses a lacrosse stick. U.S. Pat. No. 3,591,178 to Milligan discloses lacrosse rackets with plastic guard panel. U.S. Pat. No. 3,702,702 to Hoult discloses a lacrosse stick. U.S. Pat. No. 3,910,578 to Brine, Jr. discloses a lacrosse stick. U.S. Pat. No. 4,034,984 to Crawford et al. discloses a lacrosse stick.

As illustrated by a great number of patents as well as commercial sporting implements, efforts are continuously being made for their improvement. Such efforts are made to render sporting implements of ever decreasing weight and ever increasing capabilities during play. None of these previous efforts, however, provides the benefits attendant with the present invention. Additionally, the prior patents and commercial devices do not suggest the present inventive combination of methods steps and component elements arranged and configured as disclosed and claimed herein. The present invention achieves its intended purposes, objects and advantages through a new, useful and unobvious combination of method steps and component elements, with the use of a minimum number of functioning parts, at a reasonable cost to manufacture and by employing only readily available materials.

Therefore, it is an object of the present invention to provide a lacrosse stick head comprising a tube with a generally oval-shaped cross section with a length shaped into a closed loop head. The tube is fabricated of elongated fibers in a parallel configuration. The fibers are applied in layers. The fibers being coated in an elastomeric binder material.

It is a further object of the invention to manufacture improved lacrosse sticks with parts of composite materials and to do so more efficiently and economically.

It is a further object of the present invention to improve the playing characteristics of lacrosse sticks by fabricating the heads of composite materials.

It is a further object of the present invention to tailor the playing characteristics of the head of a lacrosse stick around its periphery.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the attached claims with the specific embodiments shown in the attached drawings. For the purpose of summarizing this invention, the invention may be incorporated into a lacrosse stick comprising, in combination, a handle having a lower end and an upper end with a cylindrical projection extending outwardly from the upper end. A tube with a generally oval-shaped cross section with a length is shaped into a closed loop head. The head has a far end and a near end with the region adjacent to the far end being convex and the region adjacent to the near end being concave when viewed from the top. The tube is fabricated of elongated fibers in a parallel configuration. The fibers are applied in layers. The fibers are coated in an elastomeric binder material. The fibers are selected from the class of hard flexible filaments including graphite, glass and aramid with string supporting apertures formed in the head. Strings are supported by the head in the string receiving opening. A coupling component is formed integrally with the tube at the near end. The coupling component includes a cylindrical recess receiving the projection of the handle or may preferably be formed such that the coupling component is simply the end of the stick which fits inside the handle.

The foregoing has outlined rather broadly the more pertinent and important features of the present invention. The detailed description of the invention that follows is offered so that the present contribution to the art may be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a more succinct understanding of the nature and objects of the invention, reference should be directed to the following description taken in conjunction with the accompanying drawings in which.

Similar reference characters refer to similar parts throughout the several views of the drawings.

DETAILED DESCRIPTION OF THE PREFERRED EMBODIMENT

Figure 1:
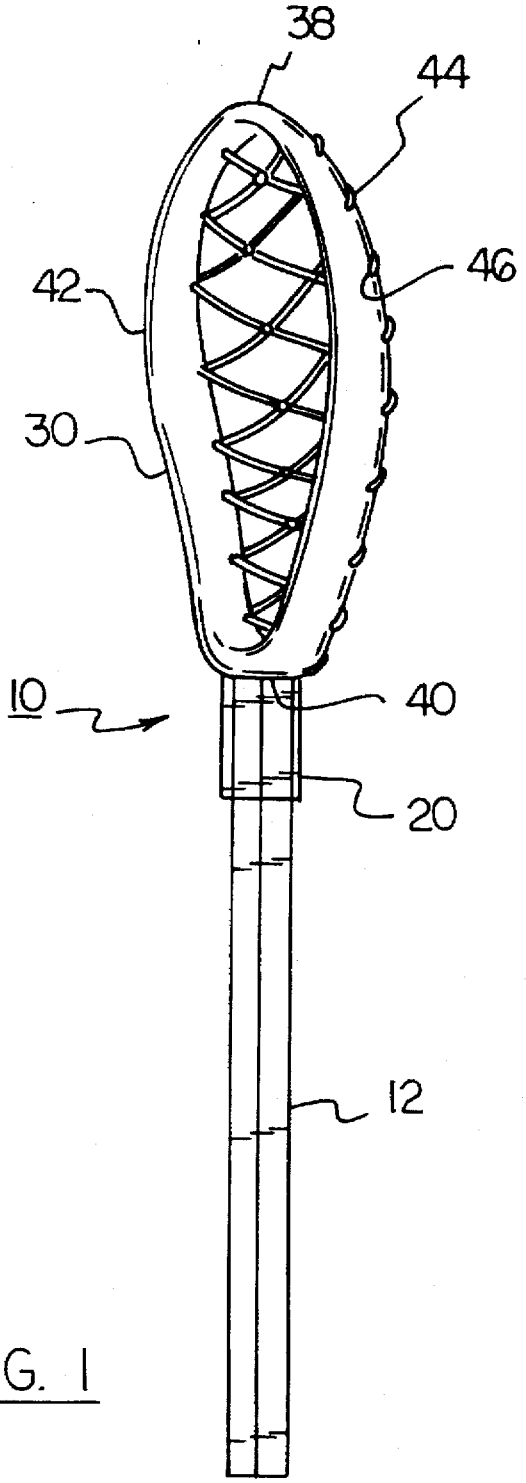
FIG. 1 is a perspective view of a lacrosse stick constructed in accordance with the principles of the present invention.
Figure 7:
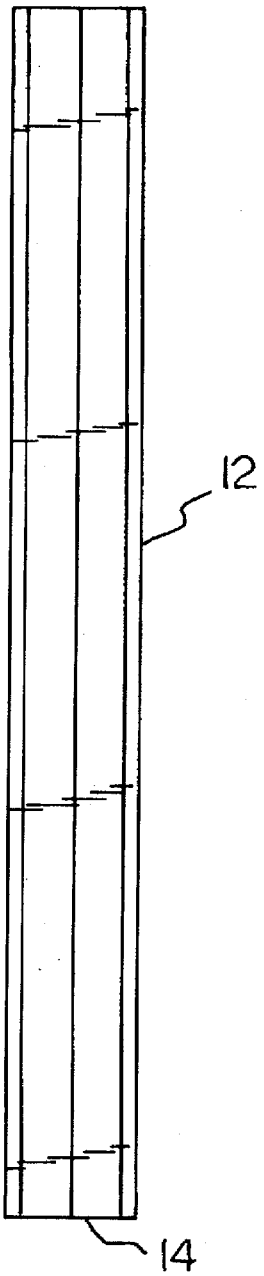
FIG. 7 is a front elevational view of the handle shown in FIG. 1.
Figure 2:
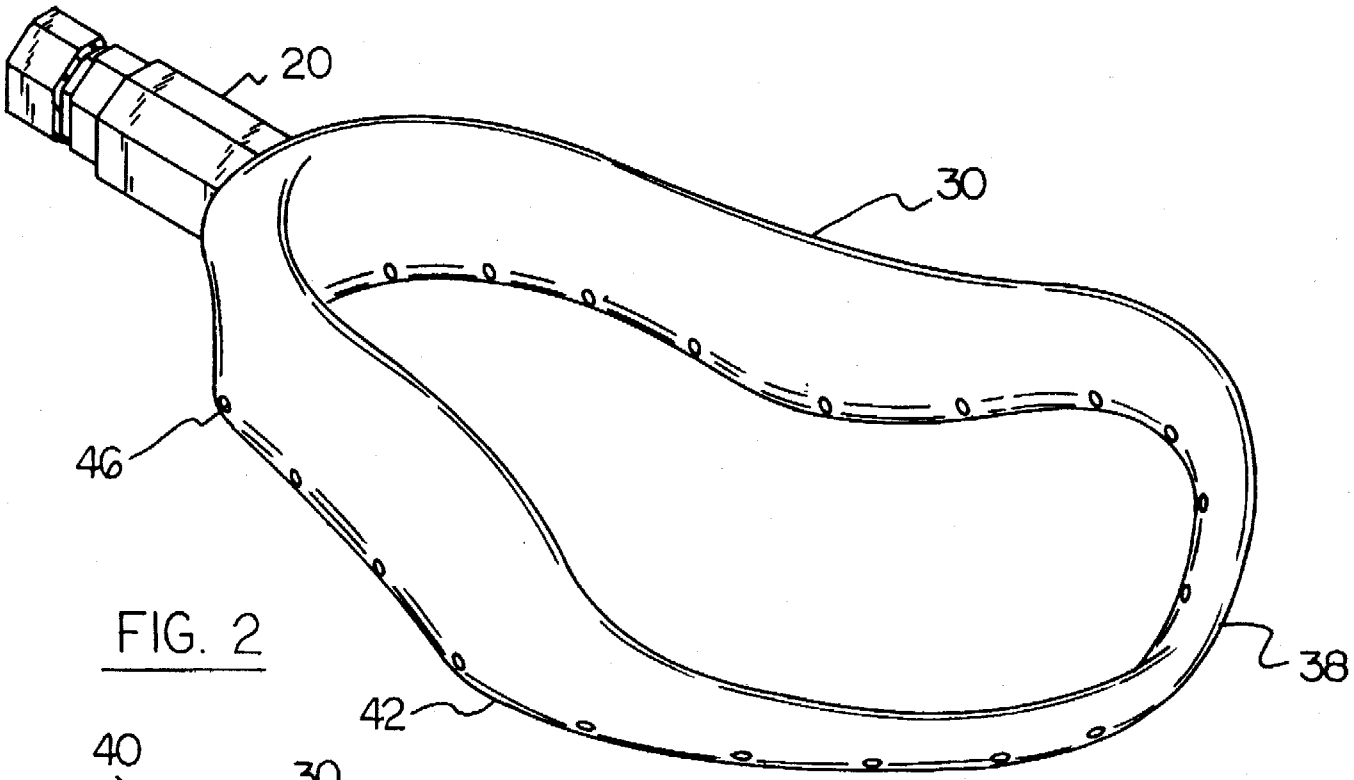
FIG. 2 is an enlarged perspective illustration of the head of the lacrosse stick shown in FIG. 1.

With particular reference to the Figures, there is shown in FIG. 1 a perspective illustration of a lacrosse stick constructed in accordance with the principles of the present invention. The major component of the lacrosse stick are the handle, the head and the coupling components therebetween.

Figure 8:
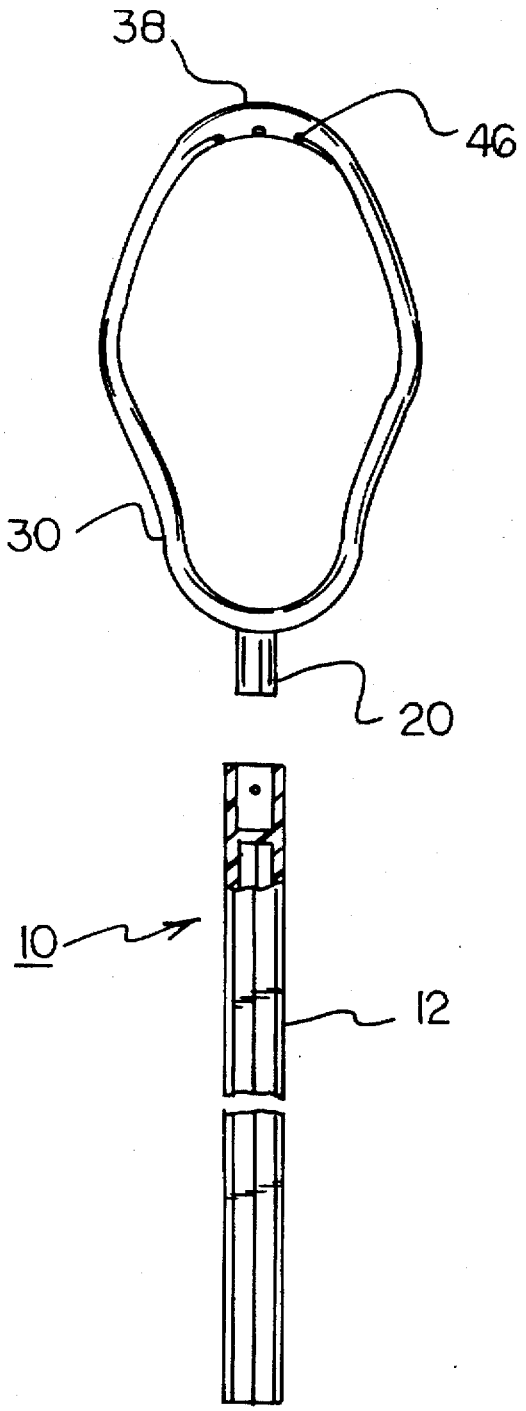
FIGS. 8 and 9 are elevational views of alternate embodiments of the invention.

One component of the lacrosse stick 10 is the handle 12. The handle is fabricated of any conventional material metal, plastic, wood composite or the like. It is provided with a elongated length, generally of a common cross-section for being held by a player. The handle has a bottom end 14 and a top end 16. At the top end, a cylindrical extension projection 18 of a common cross-sectional configuration as the full length of the stick is provided for being received within the coupling component 20 of the head as will be described. A screw 24 is threaded through an aperture 26 in the coupling component to contact the projection at the upper end of the handle. This will maintain the head and handle together during operation and use. The coupling component 20 also includes the projection 18 of the stick 12 and a cylindrical recess in an extension 28 for receiving the projection, the extension is preferably formed integrally with the head from composite materials the same as the head to thereby create an integral structure. In an alternate embodiment of the invention, the upper end of the stick may receive the projection at the lower end of the head. Note FIG. 8.

The next major component of the frame is the head 30. The head is constructed in a tubular configuration of fibers 32 in a resin matrix 34, either thermoset or thermoplastic. The frame head is shaped in an oval configuration. It may be fabricated by any of a plurality of known fabrication techniques, either the conventional laying-up of patches of composite material around the mandrel as described in the patent literature, by filament winding around a mandrel, by using braided tubes or any other method typically used to produce composite tubes.

From a fabrication standpoint, the head of the present invention is constructed in a conventional manner except for the shape and the coupling components. The first step includes the providing of a mandrel, a linear piece with a central axis. The mandrel is normally constructed of a solid elongated Teflon member, either a single piece or a plurality of pieces coupled together along their lengths as may be needed to accommodate complex shapes with different cross sectional configuration along the length.

The mandrel is then wound or wrapped with layers or strips of the composite material which will constitute the head. Adjacent to the interior surface of the windings is a thin air bladder which maybe initially placed on the mandrel prior to the winding. It may also be placed within the formed strips after the mandrel is removed. The air bladder is a thin tubular member of air impervious material which is not stretchable. It is preferably made of a nylon material which is resistant to high temperatures.

After the mandrel is removed, and with the bladder in place, the windings are bent to the intended configuration corresponding to the head of the lacrosse stick to be fabricated. In this regard, the coupling component is preferably formed simultaneously with the tube which forms the head in a manner as with racquetball rackets which is conventional and fully described in the prior art patent literature. Additional reinforcement to the area where the tube ends meet is preferably added prior to molding.

The composite strips and the interior bladder are then placed into a dummy mold with the frame and coupling component tied together with composite material whereby the pieces correspond to the shape of the finished frame. In additional, a nipple is added to the end of the frame of the bladder to allow the blowing of air into interior of the strips into contact with the mold for shaping during curing while the other end of the bladder is sealed. Alternatively, the bladder can be filled with a foam material that expands when heated and provides the necessary forming pressure during the cure cycle. The mold is then closed and placed into a platen where heat and pressure cause the windings and yoke to cure for generating the final product. Heating is done by conduction for quick and uniform heating. Upon taking the final product out of the platen and then the mold, there is no need to remove the bladder. The extreme end pieces of the windings is then cut off to remove the nipple.

The simplest process of laying up the component composite strips involves placing a plurality of strips of composite material over the mandrel, one on top of the other. The axis of each single strip overlies the axis of the mandrel and represents the radially exterior surface of the finished head and coupling component.

Figure 3:
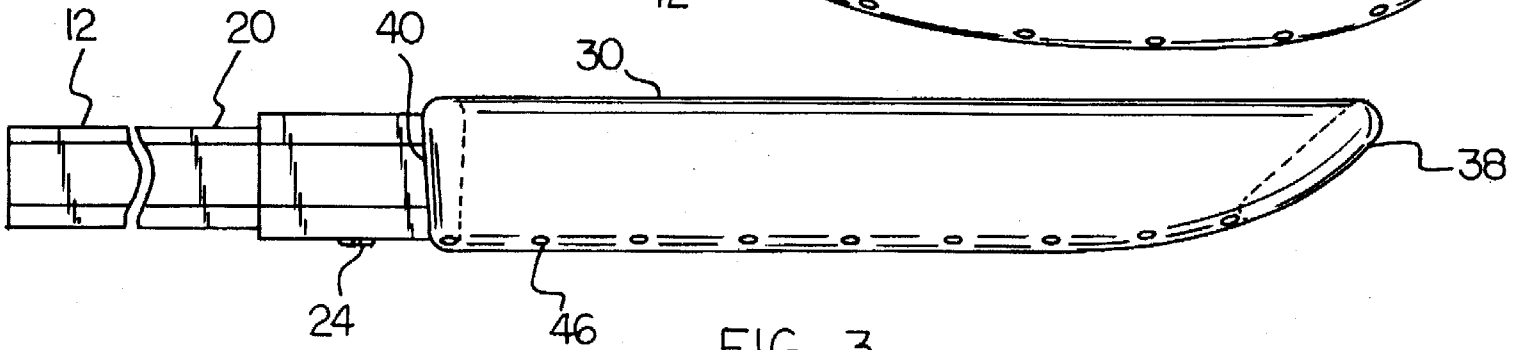
FIG. 3 is a side elevational view of the head shown in FIGS. 1 and 2.
Figure 4:
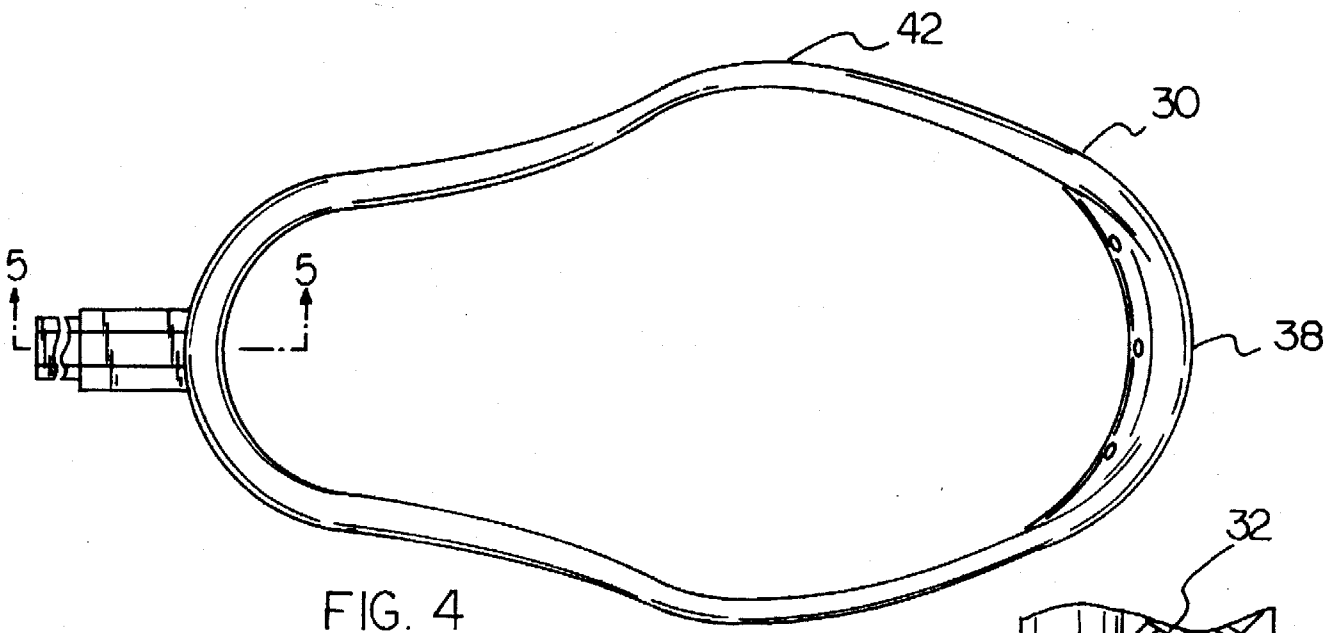
FIG. 4 is a top elevational view of the head shown in prior Figures.
Figure 5:
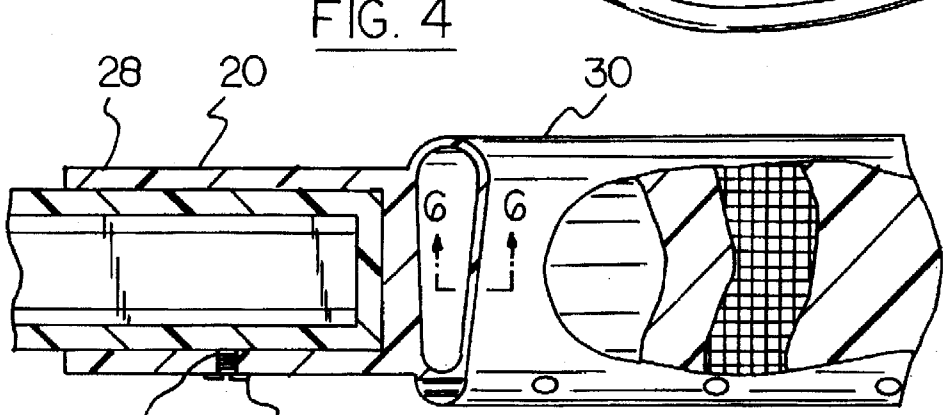
FIG. 5 is a cross-sectional view taken along line 5—5 of FIG. 4.
Figure 6:
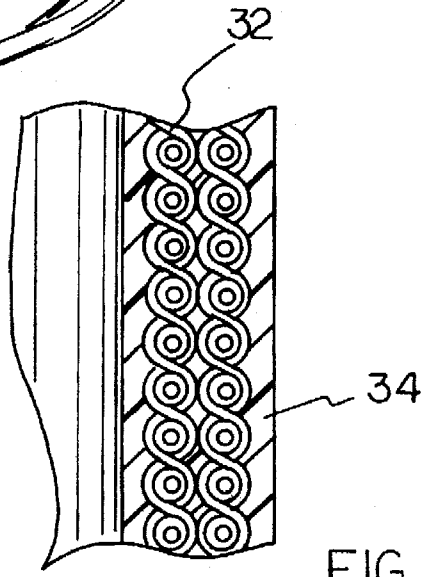
FIG. 6 is a cross-sectional view taken along line 6—6 of FIG. 5.

The head when completed is in a closed loop configuration undulating from the far end 38 to the near end 40. When viewed from the top, the central section 42 is of the greatest width. The sides of the head adjacent the far end 38 are convex when viewed from the top. Note FIG. 4. The sides of the head adjacent the near end 40 are concave or vertical when viewed from the top. When viewed from the side, the head normally has an essentially common cross-sectional configuration along the majority of its length except, at the tip end, where it is curved upwardly. Note FIG. 3. It is possible to use appropriate designs and tooling variations in the cross-section of the head along the length thereof. This will allow for the optimizing of the properties of the head along its length as for stiffness, durability and the like.

Another principal component of the lacrosse stick are the strings 44 which are essentially interwoven through small holes 46 in the frame along parallel lines. The strings lie in a loose plane and constitute a bag for catching and tossing the ball during play. The strings extend through the small holes or apertures around the entire periphery of the head. The holes are preferably provided as by drilling during a secondary operation.

Figure 9:
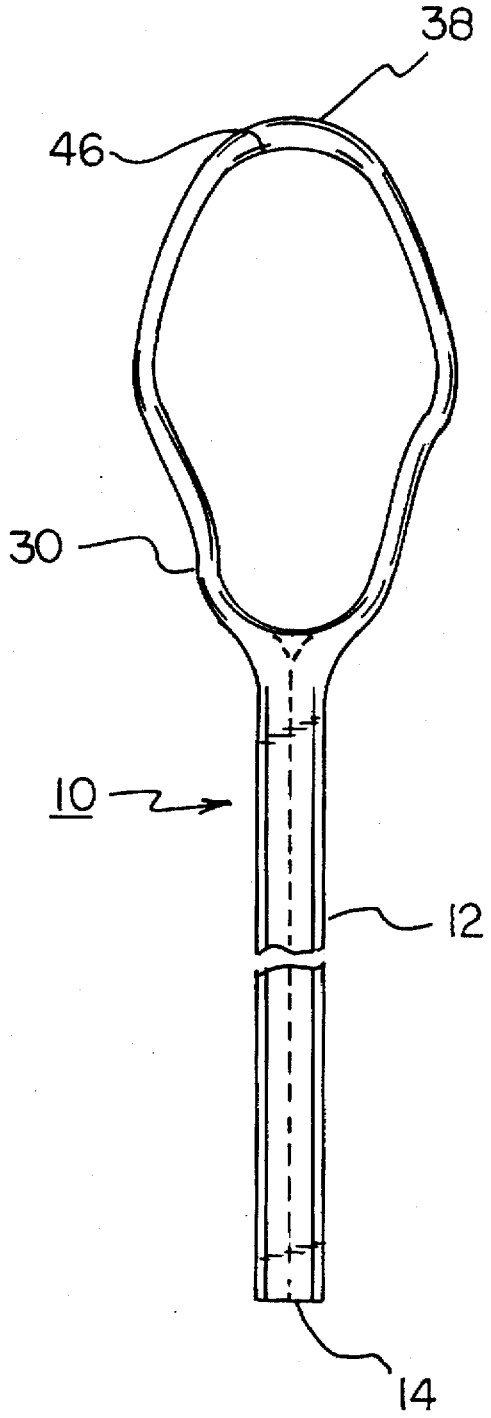

Another alternate embodiment includes the forming and molding of the head and handle from a single tube much as racquetball rackets are fabricated. This precludes the need for coupling separate components after molding. Note FIG. 9.

The present disclosure includes that contained in the appended claims as well as that of the foregoing description. Although this invention has been described in its preferred form with a certain degree of particularity, it should be understood that the present disclosure of the preferred form has been made only by way of example and that numerous changes in the details of construction and combination and arrangement of parts may be resorted to without departing from the spirit and scope of the invention.

Now that the invention has been described,

What is claimed is:

1. A lacrosse stick comprising in combination:

a handle having a lower end and an upper end with a cylindrical projection extending outwardly from the upper end;

a tube with a generally oval-shaped cross section with a length shaped into a closed loop head, the head having a far end and a near end and a top with a region adjacent to the far end being convex and a region adjacent to the near end being concave when viewed from the top, the tube being fabricated of elongated fibers in a parallel configuration, the fibers being applied in layers, the fibers being coated in a resin binder material, the fibers being selected from the class of hard flexible filaments including graphite, glass and aramid with string supporting aperture formed in the head;

strings supported by the head in a string receiving opening; and a coupling component formed integrally with the tube at the near end, the coupling component including a cylindrical recess receiving the projection of the handle with a threaded recess formed in the coupling component and further including an associated screw in the threaded recess for securing the handle and tube in the cylindrical recess.

* * * * *